US005161276A

United States Patent [19]

Hutton et al.

[11] Patent Number: 5,161,276

[45] Date of Patent: Nov. 10, 1992

[54] BED SHEET ATTACHMENT DEVICE FOR A MATTRESS

[76] Inventors: William B. Hutton; Deanice Hutton, both of P.O. Box 1092, St. Helens, Oreg. 97051

[21] Appl. No.: 866,740

[22] Filed: Apr. 10, 1992

[51] Int. Cl.[5] ..... A47C 21/02

[52] U.S. Cl. ..... 5/460; 5/498; 24/72.5

[58] Field of Search ..... 5/460, 466, 467, 494, 5/496, 498; 24/72.5

[56] References Cited

U.S. PATENT DOCUMENTS

| | | | |
|---|---|---|---|
| 2,630,507 | 3/1953 | Brown | 5/466 X |
| 2,826,766 | 3/1958 | Stoner | 5/498 |
| 3,176,326 | 4/1965 | Zysman et al. | 5/466 |
| 3,514,797 | 6/1970 | Zysman | 5/466 |
| 3,833,950 | 9/1974 | Pappathatos | 5/466 |
| 3,859,679 | 1/1970 | Bartz et al. | 5/466 |
| 4,344,196 | 8/1982 | Large | 5/460 X |
| 4,660,240 | 4/1987 | Hutton et al. | 4/451 |
| 4,662,016 | 5/1987 | Seeman | 24/72.5 X |
| 4,782,543 | 11/1988 | Hutton et al. | 5/508 |
| 4,862,541 | 9/1989 | Hutton et al. | 4/496 |
| 5,099,531 | 3/1992 | Schmier | 5/460 |

*Primary Examiner*—Michael F. Trettel

*Attorney, Agent, or Firm*—Chernoff, Vilhauer, McClung & Stenzel

[57] ABSTRACT

A device for attaching bed sheets to a mattress. Preferably attached to the mattress during manufacture, the device includes a reinforcement such as a grommet for defining and strengthening an opening in the mattress covering material, an elongate, flexible and elastic connector, a bed sheet grip attached to the elongate connector, and a coupling interconnecting the elongate connector with the grommet. In a preferred embodiment, two grommets are mounted near a corner of a mattress, using a backing plate interconnecting the grommets, and two couplings connect the ends of the elongate connector to the mattress.

22 Claims, 4 Drawing Sheets

BED SHEET ATTACHMENT DEVICE FOR A MATTRESS

BACKGROUND OF THE INVENTION

This invention relates to an attachment device and more particularly to a device for attaching a bed sheet to a mattress.

Conventional innerspring or foam mattresses have long been manufactured in twin, double, queen, and king sizes having fairly standard dimensions. In recent years, however, mattress manufacturers have begun producing new mattresses that are higher, or thicker, than previous conventional mattresses. In extreme cases, new mattresses are 16 inches high, or more than double the old conventional height of 7 inches. Manufacturers may also add quilted pads to the tops and bottoms of mattresses to create a luxury effect, which also results in a thicker mattress.

Naturally, fitted bed clothes, particularly fitted sheets and mattress pads designed for the dimensions of previously-conventional mattresses, do not properly fit these thicker, new mattresses. The corners of fitted sheets designed for older mattresses cannot fit over the bottom edges of the higher, new mattresses. Even flat sheets, if manufactured for use on the older mattresses, will seem skimpy when tucked under the edges of a new, higher mattress. Neither an older fitted sheet nor an older flat sheet will remain properly in place on a new, higher mattress. People contemplating the purchase of such a new mattress are therefore also confronted with the need for new bed clothes to fit the new mattress. The added expense of replacing all their fitted bed clothes may deter some people from purchasing a new-style mattress.

Alternatives to completely replacing the bedding designed specifically for previously-conventional mattresses have been suggested. Some of these alternatives are to modify the older sheets or to provide a means for fastening the older sheets around the bed. U.S. Pat. No. 4,862,541 discloses one device for attaching a sheet to a mattress. The device consists of an elongate strap and two fasteners. The strap is positioned under the mattress at a corner with strap ends projecting, and a fastener attachable to a sheet is mounted on each projecting strap end. This device must be separately purchased and installed.

U.S. Pat. Nos. 4,782,543 and 4,660,240 disclose devices for fastening sheets and other bedding to a water bed. These devices are not particularly well adapted for use with a conventional mattress, and also must be separately purchased and installed.

What is still needed, then, is a device which may be included as an integral part of a new, higher mattress, to attach sheets to such a mattress. Such a bed sheet attachment device, attachable to a mattress, would preferably be installed by the manufacturer during manufacture of the mattress.

SUMMARY OF THE INVENTION

The present invention provides an improved bed sheet attachment device preferably included in a mattress during manufacture of the mattress. Such bed sheet attachment device can then optionally be used to attach bed clothing. The bed sheet attachment device of the present invention includes a reinforcement structure, such as a grommet, to define an opening in the material forming the exterior of the mattress, and to protect and reinforce the material surrounding the opening, as a place for mounting the remainder of the device of the invention. A rotatable coupler, connected to the grommet or other rigid reinforcement structure, holds an elongate flexible connector to which is attached a gripper for gripping a bed sheet. The elongate flexible connector is preferably of an elastic material capable of recovering its size and shape after being deformed, in order to hold bed sheets snugly in place on a mattress by elastic tension in the connectors.

In a preferred embodiment of the invention, a pair of such reinforcement structures in the form of grommets are fastened to the mattress covering material near a corner of the mattress, separated by a short distance. A coupler is engaged rotatably in each grommet, and one of the two opposite ends of the elongate flexible connector is attached to each coupler, preferably by an attachment loop. A gripper for the bed sheet is attached to the medial portion of the elongate connector. A backer plate preferably interconnects the two grommets to provide added strength and stability to the connection of each grommet to the mattress covering material.

The bed sheet gripper portion of the bed sheet attachment device of the present invention includes a plate defining a slot extending through it. At one end the slot is large enough to receive one end of a stud, with a portion of the bed sheet placed around the stud. The plate is placed beneath the sheet and the stud is pushed down through the enlarged portion of the slot from above the sheet, with a surrounding portion of the sheet being forced into the slot. The stud is then moved into the narrow portion of the slot to grip the sheet between the interior of the slot and a neck of the stud.

A margin of the lower end of the gripper defines a hook portion for receiving the elongate connector. In a preferred embodiment of the present invention the hook portion includes a throat area whose width is smaller than the diameter of the elongate flexible connector, to insure the firm engagement of the flexible connector in the throat area.

With such an attachment device preferably located at each corner of the mattress, the tension of each elongate connector and the location of each gripper can be adjusted to enable the grippers to grasp the corners of a bed sheet which otherwise would be too small to fit on a new, thicker mattress, and fasten the sheet to the bed.

It is therefore a principal object of the present invention to provide a device for attaching bed sheets to a mattress.

It is a further object of the present invention to provide a mattress including a device attachable to the mattress during manufacture, for attaching bed sheets to the mattress.

It is also an object of the invention to provide a device for attaching a bed sheet designed for a seven inch high mattress to a mattress having a height of more than seven inches.

An important feature of the present device is the provision of a rotatable coupler with a pivotable attachment loop by which the elongate connector is adjustably coupled to a mattress.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
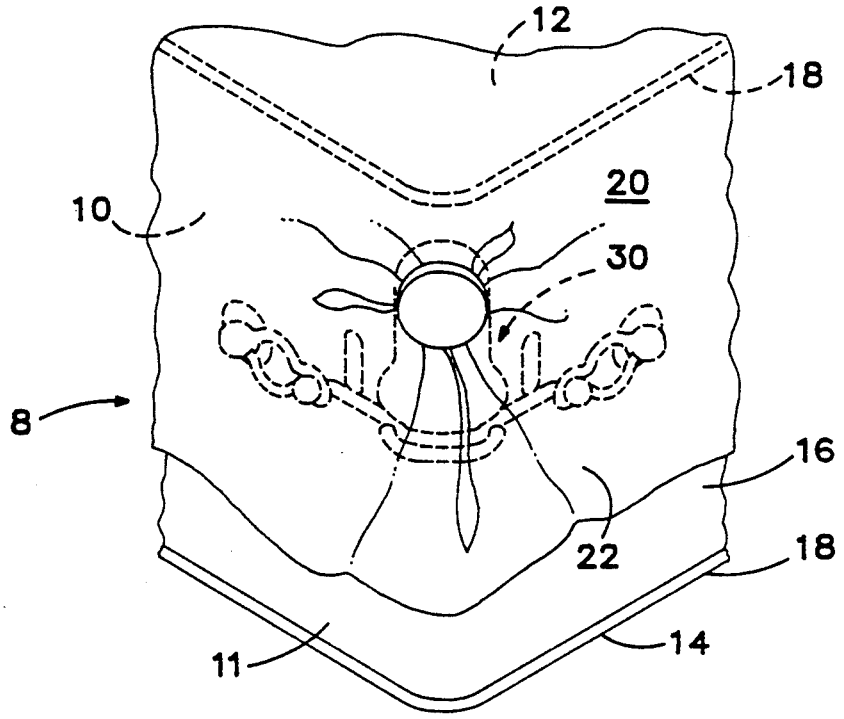
FIG. 1 is a perspective view of the top of one corner of a mattress equipped with a bed sheet attachment device embodying the present invention, together with a portion of an installed bed sheet held by the attachment device.

Referring now to the drawings, and particularly to FIGS. I and 2, a mattress 8, of which only a corner portion 10 is shown, includes mattress covering material 11 forming a top 12, a bottom 14, and a side wall 16 connecting the top and the bottom. The margins of the side wall 16 and the top 12, and the margins of the side wall 16 and the bottom 14 are bound together and protected by a border 18. A sheet 20, which could be either a flat sheet or one with a fitted corner, and which might not be large enough to cover the full height of the mattress 8, is shown attached to the mattress at the corner 10 by a bed sheet attachment device 30 embodying the present invention. The bed sheet attachment device 30 firmly secures the corner 22 of the sheet 20 to the corner 10 of the mattress and holds it snugly in a desired position by tension in elastic members. Preferably, one of the bed sheet attachment devices 30 is located at each of the four corners of the mattress, and additional devices 30 could be attached to the mattress along its sides or ends.

Figure 2:
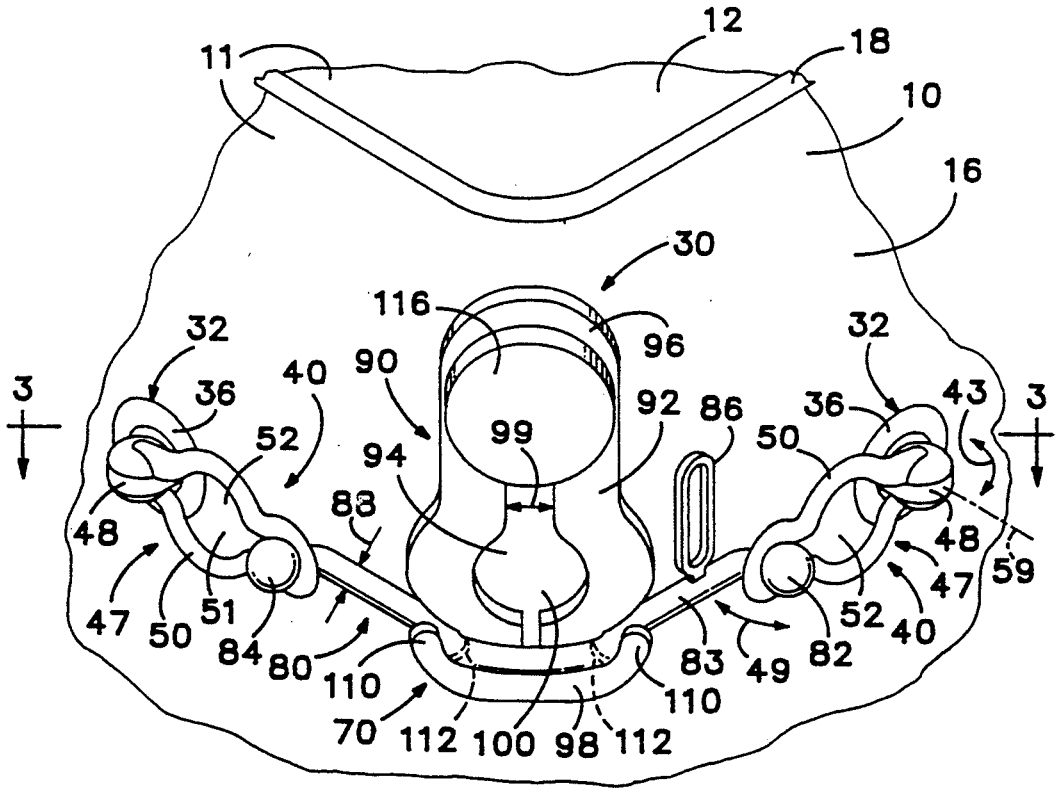
FIG. 2 is a perspective view of a portion of the mattress corner equipped with the device shown in FIG. 1 for attaching a bed sheet.
Figure 3:
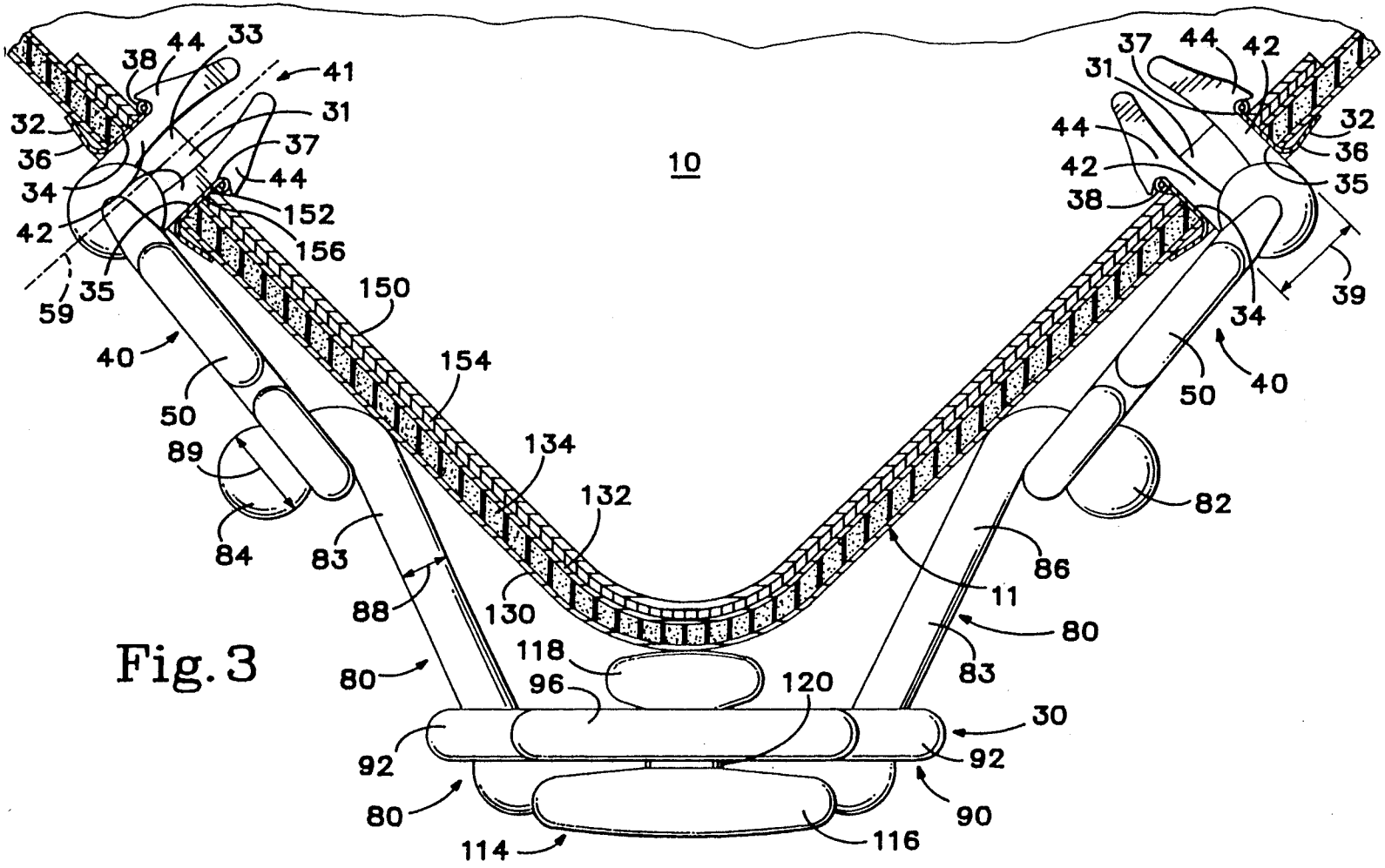
FIG. 3 is a top plan view of the portion of a mattress and the bed sheet attachment device shown in FIG. 2, with a portion of the side wall of the mattress corner shown in section view taken in the plane including line 3—3 of FIG. 2.

As best shown in FIGS. 2 and 3, the attachment device 30 includes a reinforcement member such as a grommet 32 for defining and reinforcing an opening 34 through the mattress covering material 11. The grommet 32 preferably has a cylindrical tubular portion 33 and integrally formed annular flanges 36 and 38 located respectively at the outer end 35 and at the inner end 37 of the tubular portion 33. The diameter 39 of the tubular portion 33 defines the diameter of the opening 34. The outer flange 36 extends radially outward to engage the outer surface of the mattress covering material 11, while the inner flange 38 is preferably rolled during attachment of the grommet to the covering material 11 to engage a backer plate 150 as will be explained below in greater detail. While the reinforcement member is preferably a grommet 32 formed of a metal such as brass or steel, other materials, such as polymeric materials, that are rigid but not brittle could also be used, so long as the reinforcement member is capable of receiving and allowing rotation of a coupling, as will be explained presently.

Figure 4:
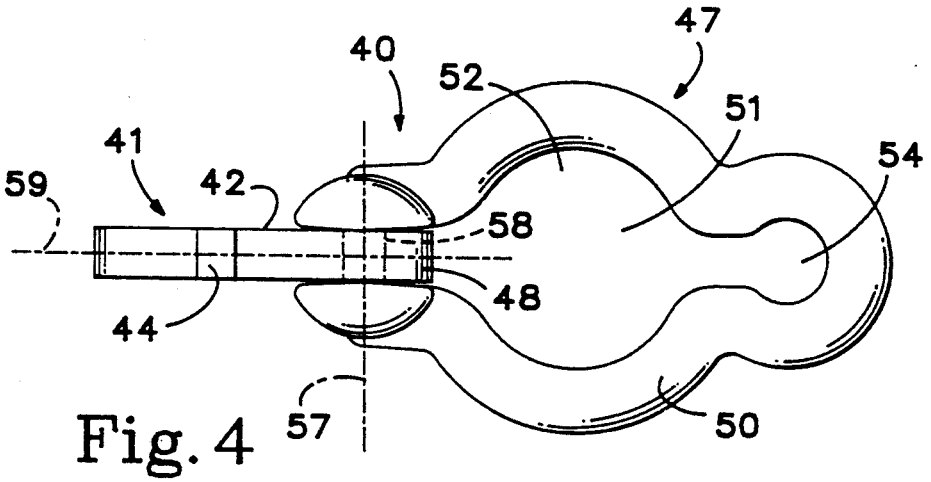
FIG. 4 is a top plan view of the coupler portion of the bed sheet attachment device.
Figure 5:
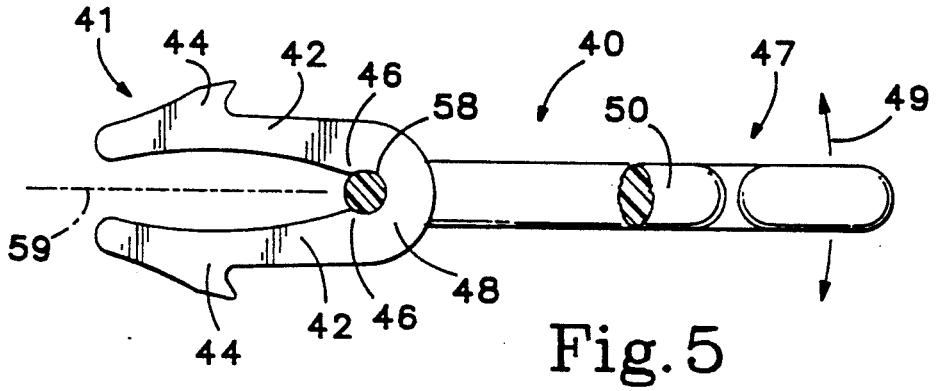
FIG. 5 is a side elevational view of the coupler shown in FIG. 4.
Figure 6:
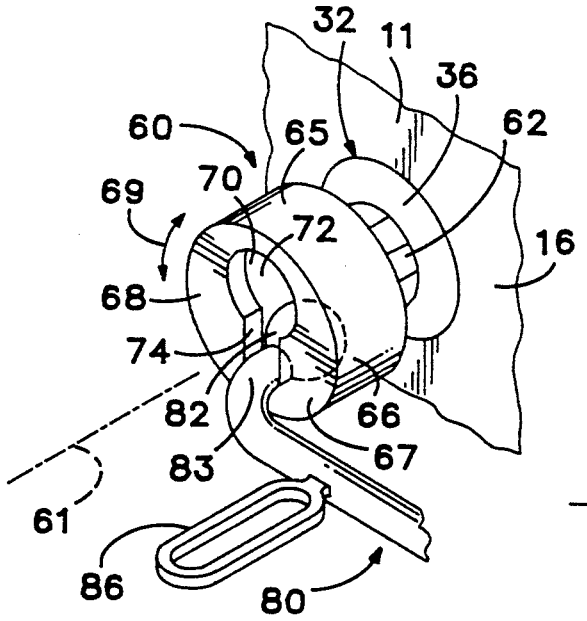
FIG. 6 is a perspective view of a portion of a mattress equipped with a coupler which is part of an alternative embodiment of the invention, together with an end of an attached connector.
Figure 7:
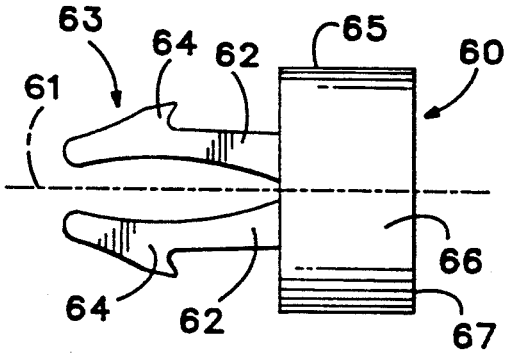
FIG. 7 is a side elevational view of the coupler shown in FIG. 6.
Figure 8:
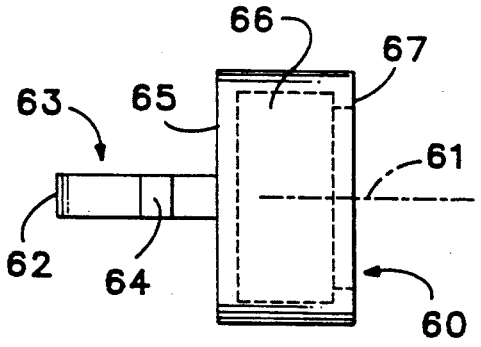
FIG. 8 is a top plan view of the coupler shown in FIG. 6.
Figure 9:
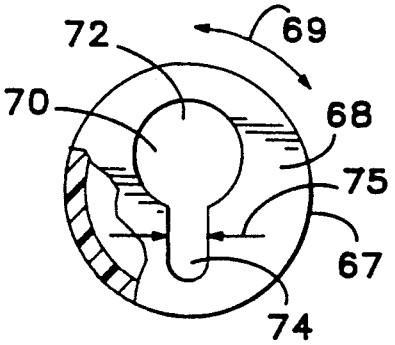
FIG. 9 is a partially cut-away end view of the coupler shown in FIG. 6.

A coupling assembly 40 includes a U-shaped, or first, element 41 including a pair of projecting arms 42, shown in FIGS. 3–5, used to engage the grommet 32. The first element 41 of the coupling assembly 40 has a longitudinal axis 59 extending in a direction generally parallel with the arms 42. The arms 42 are resiliently interconnected with each other at their base ends 46, by a base 48, forming the "U" shape of the element 41. An outwardly directed barb 44 is located on each projecting arm 42, spaced apart from the base ends 46 by at least the length of the tubular portion 33, in order to receive the grommet 32 between each barb 44 and the base ends 46. The arms 42 are biased elastically to the "U" shape shown in FIG. 5, but the arms 42 and the base 48 are resiliently flexible enough to permit the arms to be squeezed together by camming action of the barbs 44 to insert the arms 42 through the tubular portion 33 of the grommet 32 far enough to release the barbs 44 at the inner end 37 of the grommet to engage the flange 38. The arms 42 separate to contact the interior of the tubular portion and the barbs 44 act as detents to attach the coupling assembly 40 to a grommet 32.

A loop, or second, element 47 of the coupling assembly 40 includes an attachment loop 50 and a shaft 58. The attachment loop 50 defines an opening 51 including a wider medial portion 52 and a narrow portion 54 having a width small enough for it to grip an elongate connector 80 firmly and securely when either end 82 or 84 of the connector 80 is passed through the medial portion 52 of the loop and a portion of the connector 80 is pushed into the narrow portion 54. The shaft 58 is located at the side of the opening 51 opposite the narrow portion 54. The loop member 47 pivots with respect to the U-shaped base 48 about an axis 57 defined by the shaft 58, as indicated by the arrow 49 and as best shown in FIG. 5. Coupling assembly 40 is preferably formed of a suitable thermoplastic synthetic material, such as polyethylene, high density polyethylene, or polypropylene.

The barb 44 of each arm 42 matingly engages the inner flange 38 of the grommet 32, attaching the coupling assembly 40 to the grommet 32, yet permitting adjustment of the position of the coupling assembly 40 relative to the grommet 32 by rotation of the first element 41 about the axis 59 as indicated by the arrow 43. In addition, the loop element 47 of the coupling assembly 40 can be pivoted relative to first element 41 by the shaft 58 in the base 4B.

The elongate flexible connector 80 has a generally uniform circular cross section. The medial portion 83 of the connector 80 has a diameter 88 larger than the width of the narrow portion 54 (FIG. 4) of the attachment loop 50, while the end portions 82, 84 are preferably spherical stoppers which have a diameter 89 larger than the diameter 88 of the connector and thus larger than the width of the narrow portion 54 of the opening 51 in the attachment loop 50, for secure engagement of the connector by the attachment loop. The connector 80 is preferably elastically extensible and compressible, and preferably can be stretched elastically to nearly twice its length. The connector 80 can also be deformed to reduce its diameter to pass the connector into the narrow portion 54 of the attachment loop 50. The connector can thus be firmly engaged in the narrow portion 54 of the attachment loop 50. The connector 80 is preferably formed of a thermoplastic rubber-like synthetic material of suitable strength and elasticity and capable of being formed by injection molding. A suitable material is manufactured by Shell Oil Company and available under the trademark KRAYTON, through GLS Plastics, Inc. of Cary, Ill.

The gripper portion 90 of the bed sheet attachment device of the present invention, FIGS. 1 and 2, includes a first member or plate 92 which may be made of a conveniently formed material such as a tough, rigid polymeric material, for example. The first member or plate 92 has an upper end 96 and a lower end 98, the words "upper" and "lower" referring to the normal position of the plate 92 when the attachment device 30 is in use, as shown in FIGS. 1 and 2. The plate 92 is generally flat, having opposite sides which are generally parallel, and a thickness which is great enough (for example, at least about 3/16 inch) to supply necessary strength and avoid sharp corners or edges which might tear the sheet 20.

The plate 92 defines an opening from the first side to the opposite side including an elongate slot 94 having a circular enlargement 100 located proximate the lower end 98 of the plate 92. The slot 94 has a width 99 which preferably tapers inward slightly to a minimum closer to the upper end 96 of the plate 92. As will be appreciated, the circular enlargement 100 might be of another shape, as long as it is larger than the width 99 of the portion of the slot 94 which extends beyond the enlargement 100 toward the upper end 96 of the plate 92.

The lower end 98 of the plate 92 includes a hook portion 110. The hook portion 110 defines a throat area 112 narrower than the diameter 88 of the elongate connector 80, which receives and securely holds a medial portion of the connector 80.

A second part of the gripper 90, a stud 114, includes a circular base portion 116, a circular head portion 118 having a diameter smaller than the enlargement 100 of the slot 94, and an interconnecting neck portion 120 whose diameter is approximately equal to or only slightly smaller than the width 99 at the narrowest portion of the slot 94. Since the head portion 118 is smaller in diameter than the circular enlargement 100 of the slot 94, and because the width 99 of at least most of the slot 94 is greater than the diameter of the neck 120, the stud 114 may be fitted into the slot 94 in the plate member 92 as is shown in FIGS. 1 and 2, with portions of the sheet 20 extending around the head 118 and neck 120. Sufficient clearance is provided between the neck 120 and the interior of the slot portion 94 to receive the sheet 20 and hold it securely when the neck 120 of the stud 114 is located near the upper end 96 within the slot 94.

Preferably, as shown in FIG. 3, the head 118 of the stud 114 is shaped to avoid unnecessarily stressing a sheet held by the attachment device 30.

Figure 10:
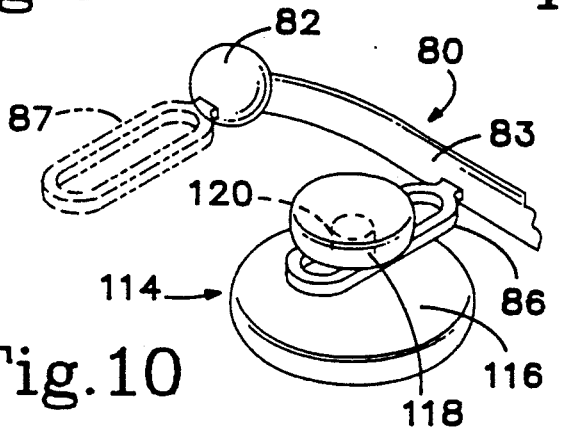
FIG. 10 is a perspective view showing an end portion of an elongate connector which is part of the bed sheet attachment device of the present invention, with a stud member shown held in a retainer loop attached to the connector.

When the gripper 90 is not attached to any bed covering, the stud 114 may be placed through the loop 86 attached to the elongate connector 80, where it will be retained in a convenient location as shown in FIG. 10. The loop 86 is formed integrally with the connector 80 and is preferably large enough to receive the head 118 of the stud 114, but too small to permit passage of the base portion 116. Loop 87, shown in broken line in FIG. 10, illustrates an alternative location for the storage loop on the connector 80.

Referring now to FIG. 3, the attachment device 30 is preferably installed during the manufacture of a mattress by installing grommets 32 at appropriate places on the part of the mattress covering material 11 which will become the side wall 16. The mattress covering material 11 generally includes an outermost layer 130 of a sturdy, woven material such as mattress ticking, a non-woven innermost layer 132 (for example, of thermally bonded fiber), and a middle layer 134 of polymeric foam. When quilted together the three layers form the mattress covering material 11. The outer flange 36 of the grommet 32 rests against the outermost layer 130 of the mattress covering, while the inner flange 38 is located on the opposite, inner side of the mattress covering material 11.

Additional stabilizing elements may be placed between the innermost layer 132 of the mattress covering material 11 and the inner flange 38 of the grommet 32 to provide a desired degree of security of the attachment of the grommet 32 to the mattress covering material 11. These stabilizing elements include backing plates formed from suitable materials such as metal or cardboard, as is known for attachment of grommets to the sides of mattresses for attachment of carrying handles.

As shown in FIG. 3, such additional stabilizing materials may include a metal backing plate 150 and a cardboard backing plate 154 located between the inner flange 38 of the grommet 32 and the innermost layer 132 of the mattress covering material 11. The metal backing plate 150 is generally rectangular in shape, defining openings 152 large enough in size to receive the cylindrical tubular part 33 of each grommet 32. Cardboard backing plate 154 defines openings 156 generally corresponding to openings 152 in the metal backing plate in both size and location. The cardboard backing plate 154 is preferably larger than the metal backing plate 150 and is located between the metal backing plate 150 and the non-woven innermost layer 132 of the mattress covering material 11 to protect the innermost layer 132 from wear-producing contact with the corners and edges of the metal backing plate 150.

To attach the bed sheet 20 to the corner 10 of the mattress using the attachment device 30, the sheet is laid over the first member or plate 92 of the gripper 90 as it is held up in a desired position adjacent the bed sheet corner 22 with a desired amount of tension applied to the flexible connector 80. While the plate 92 is held in the desired position with the sheet 20 in place above it, the head 118 of the stud 114 is pushed through the circular enlargement 100 in the plate member, pushing a small part of the sheet 20 through the circular enlargement. The stud 114 is then slid into the smaller width 99 of the slot 94 with the sheet 20 surrounding the neck portion 120. The same process is repeated at each corner of the mattress. When the sheet 20 has been attached to the mattress in this fashion, only the base 116 of each of the studs 114 will be visible, and even the base will ordinarily be out of view between the mattress and the rest of the bedding on the bed.

When using the bed sheet attachment devices 30 of the present invention it is unnecessary to utilize bed sheets designed specifically for use with the new higher or thicker mattresses; fitted sheets which are designed for thinner conventional mattresses can be held by the attachment devices 30.

An alternative coupling portion useful as a part of the present invention is coupling element 60, shown in FIGS. 6–9. The coupling element 60 is preferably generally rigid, but tough, and may be formed integrally of a suitable thermoplastic synthetic material. Coupling element 60 has a first end 63 which may be coupled to a reinforcement member, such as a grommet 32, by means of flexible projecting arms 62, with barbs 64, similar to arms 42 and barbs 44. The coupling element 60 has a longitudinal axis 61, and each arm 62 is connected to and projects from a first end 65 of a hollow cylindrical body 66 in a direction generally parallel with the longitudinal axis 61. The arms 62 can be inserted through and engage the grommet 32 as can the arms 42, so that the coupling element 60 is rotatable in the grommet 32, about the axis 61, as indicated by the arrow 69.

The cylindrical body 66 has a second end 67 including a face 68 defining a keyhole-shaped opening 70 with a wider upper portion 72 narrowing to a lower narrow portion 74. The narrow portion 74 has a width 75 sufficiently small to receive and tightly, yet releasably, grip the medial portion 83 of the elongate connector 80, which can be deformed elastically to fit within the width 75 of the opening 74. The wider upper portion 72 of the opening 74 is wide enough to receive the end portions 82 and 84 of the elongate connector 80, but the end portions 82 and 84 are too large to pass through the narrow portion 74 of the opening 70.

Figure 11:
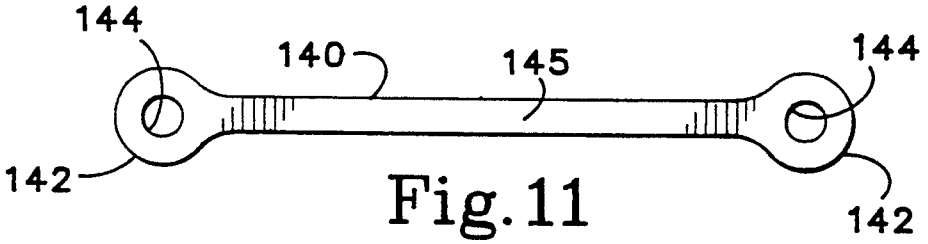
FIG. 11 is a plan view of an alternative backing plate for use in the present invention.

A metal backing plate 140 shown in FIG. 11 is an alternative to the metal backing plate 150. Each end portion 142 of backing plate 140 defines an opening 144, while a central portion 145 is narrower than the end portions 142, to facilitate flexing the backing plate at the corner 10 of the mattress. Each opening 144 of backing plate 140 is large enough to receive a rigid reinforcing member, such as a grommet 32, to interconnect the grommets 32 and help to reinforce and stabilize the respective openings 34 in the mattress covering material 11.

Figure 12:
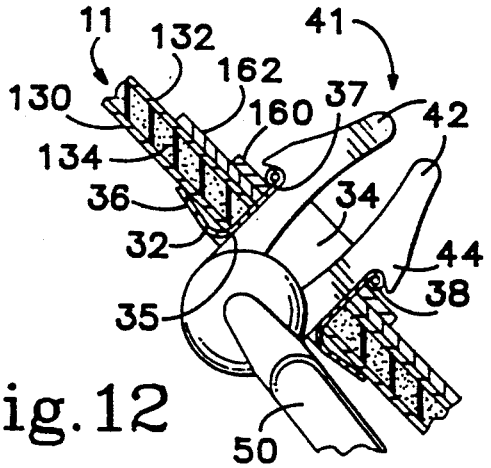
FIG. 12 is a sectional view of a portion of a side wall of a mattress equipped with a bed sheet retainer according to the invention including a second alternative backing plate.

In FIG. 12, a circular backing plate 160 is shown associated with a single grommet 32 to strengthen the attachment of a grommet to the mattress covering material 11. The circular backing plate 160 is located between the inner flange 38 of the grommet 32 and a larger cardboard backing plate 162.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for attaching a bed sheet to a mattress including mattress covering material defining a top, a bottom, and a side wall connecting the top and the bottom, comprising:

(a) reinforcement means for defining an opening in said mattress covering material and for reinforcing said mattress covering material surrounding said opening;

(b) an elongate flexible connector having first and second opposite ends and a medial portion therebetween;

(c) coupling means, having a first element and a second element, for coupling said elongate flexible connector to said reinforcement means, said first element of said coupling means including means for rotatably engaging said reinforcement means, and said second element of said coupling means including means for holding said elongate flexible connector; and (d) grip means for holding a bed sheet, a portion of said grip means defining a hook portion for receiving and holding a part of said elongate flexible connector spaced apart from said coupling means.

2. The device of claim 1 wherein said reinforcement means includes means for attaching said reinforcement means to a side wall of the mattress.

3. The device of claim 1, including a backing member associated with said reinforcement means.

4. The device of claim 1, including two of said reinforcement means and two of said coupling means, each said coupling means engaging a respective one of said reinforcement means and each of said coupling means engaging said elongate flexible connector proximate a respective one of said opposite ends.

5. The device of claim 1 wherein said elongate flexible connector is elastic.

6. The device of claim 1 wherein said coupling means includes a first member defining said first element, said first element having a longitudinal axis, and a second member defining said second element, said second member being pivotable with respect to said first member about an axis extending transversely with respect to said longitudinal axis.

7. The device of claim 6 wherein said first element of said coupling means includes elastically biased detent means for engaging said reinforcement means and thereby fastening said coupling means to said reinforcement means.

8. The device of claim 7 wherein said second element of said coupling means includes a rigid attachment loop and a shaft, said loop defining an opening including a narrow portion having a width small enough for said elongate connector to be gripped securely by said loop when placed into said narrow portion, and wherein said first element includes a U-shaped portion defining said flexible detent means, said U-shaped portion having projecting first and second arms and a base portion interconnecting said first and second arms, each said arm having a barb, said U-shaped portion engaging said shaft and being disposed rotatably about said shaft.

9. The device of claim 1 wherein said grip means comprises a first member having a lower end and an upper end and defining a longitudinal slot having a narrow portion and an enlargement located proximate said lower end, said lower end of said first member having a marginal portion defining a hook portion adapted for releasably receiving said connector; and a stud, said stud having a base too large to pass through said enlargement of said slot, a head portion small enough to pass through said enlargement but too large to pass through said narrow portion of said slot, and a neck interconnecting said head and said base.

10. The device of claim 1 wherein said first element of said coupling means includes elastically biased detent means for engaging said reinforcement means and thereby fastening said coupling means to said reinforcement means.

11. The device of claim 10 wherein said first element of said coupling means includes a longitudinal axis and said coupling means is rotatable about an axis generally parallel with said longitudinal axis.

12. The device of claim 10 wherein said coupling means includes a cylindrical portion having a face and a longitudinal axis, said detent means including a flexible arm projecting from said cylindrical member generally parallel with said longitudinal axis, said arm having a barb for engaging said reinforcement means, and wherein said second element of said coupling means includes said face of said cylindrical member, a portion of said face defining a keyhole-shaped opening for receiving and gripping said elongate flexible connector.

13. A mattress, comprising:

(a) a mattress covering defining a top, a bottom, and a side wall connecting said top and said bottom;

(b) reinforcement means for defining an opening in said mattress covering and for reinforcing said mattress covering surrounding said opening;

(c) an elongate flexible connector having first and second opposite ends and a medial portion therebetween;

(d) coupling means having opposite first and second ends for coupling said elongate flexible connector to said reinforcement means, said first element of said coupling means including means for rotatably engaging said reinforcement means, and said second element of said coupling means including means for holding said elongate flexible connector proximate one of said opposite ends thereof; and (e) grip means for holding a bed sheet, a portion of said grip means defining a hook portion for receiving and holding a part of said elongate flexible connector spaced apart from said coupling means.

14. The mattress of claim 13 wherein said reinforcement means includes means for attaching said reinforcement means to said side wall of said mattress.

15. The mattress of claim 13, including a backing member associated with said reinforcement means.

16. The mattress of claim 13, including two of said reinforcement means and two of said coupling means, each said coupling means engaging a respective one of said reinforcement means and each of said coupling means engaging said elongate flexible connector proximate a respective one of said opposite ends.

17. The mattress of claim 16 wherein said two reinforcement means are attached to said side wall of said mattress in spaced apart relationship.

18. The mattress of claim 17, including a single backing member associated with and interconnecting said two reinforcement means.

19. The mattress of claim 17 wherein said mattress has a corner and said reinforcement means are attached to said side wall proximate said corner.

20. The mattress of claim 13 wherein said elongate flexible connector is elastic.

21. The mattress of claim 13 wherein said coupling means includes a first member defining said first element, said first: element having a longitudinal axis, and a second member defining said second element, said second member being pivotable with respect to said first member about an axis extending transversely with respect to said longitudinal axis.

22. The mattress of claim 13 wherein said first element of said coupling means includes flexible detent means for engaging said reinforcement means and thereby fastening said coupling means to said reinforcement means.

* * * * *

UNITED STATES PATENT AND TRADEMARK OFFICE

CERTIFICATE OF CORRECTION

PATENT NO. : 5,161,276

DATED : November 10, 1992

INVENTOR(S) : William B. Hutton; Deanice Hutton

It is certified that error appears in the above-identified patent and that said Letters Patent is hereby corrected as shown below:

Col. 4 Line 64 Delete "4B" and insert --48--, in place thereof.

Signed and Sealed this

Twelfth Day of October, 1993

*Attest:*

Bruce Lehman

BRUCE LEHMAN

*Attesting Officer*

*Commissioner of Patents and Trademarks*